United States Patent [19]

Yamazaki et al.

[11] Patent Number: 4,739,216

[45] Date of Patent: Apr. 19, 1988

[54] COLOR PICTURE TUBE HAVING A SHADOW MASK MOUNTED UNDER COMPRESSIVE STRESS IN A SUPPORT FRAME

[75] Inventors: Hidetoshi Yamazaki; Masatsugu Inoue, both of Fukaya, Japan

[73] Assignee: Kabushiki Kaisha Toshiba, Kawasaki, Japan

[21] Appl. No.: 813,051

[22] Filed: Dec. 24, 1985

[30] Foreign Application Priority Data

Dec. 27, 1984 [JP] Japan ..... 59-273635

[51] Int. Cl.[4] ..... H01J 29/07; H01J 29/82

[52] U.S. Cl. ..... 313/407; 313/402

[58] Field of Search ..... 313/402, 407, 482

[56] References Cited

U.S. PATENT DOCUMENTS 3,808,493 4/1974 Kawamura et al. ..... 313/404

3,936,691 2/1976 Bakker et al. ..... 313/407

FOREIGN PATENT DOCUMENTS 5549375 12/1980 Japan .

149639 8/1984 Japan ..... 313/407

*Primary Examiner*—David K. Moore

*Assistant Examiner*—K. Wieder

*Attorney, Agent, or Firm*—Oblon, Fisher, Spivak, McClelland & Maier

[57] ABSTRACT

In a color picture tube in which an electron beam produced by an electron gun passes through apertures in a shadow mask structure and excites a phosphor screen, the shadow mask structure comprises a shadow mask having an electron beam penetration area and a frame portion supporting this shadow mask. The shadow mask is formed of a metal of a lower coefficient of thermal expansion than the frame portion. The shadow mask has its periphery bent to form a skirt portion and the skirt portion is fixed by welding to the frame inner wall. The skirt portion is subject to an inward compressive stress from the frame portion, and by means of this stress deformation during the manufacturing process and during operation is prevented.

7 Claims, 5 Drawing Sheets

COLOR PICTURE TUBE HAVING A SHADOW MASK MOUNTED UNDER COMPRESSIVE STRESS IN A SUPPORT FRAME

BACKGROUND OF THE INVENTION

The present invention relates to a shadow mask type color picture tube and, more particularly, to the structure of a shadow mask assembly.

In general, a color picture tube of the shadow mask type has a tube envelope which is constituted by a panel section, a funnel section and a neck section. Three electron guns are arranged in the neck section. A color selecting electrode assembly, i.e., the shadow mask assembly, is disposed in the panel section adjacent to a phosphor screen formed on an inner surface of the panel section of the tube envelope. The shadow mask assembly is constituted by a rectangular shadow mask having a color selecting function with respect to three electron beams emitted from the electron guns, and a frame for mounting the shadow mask on the panel section at a given distance from its inner surface.

The shadow mask has a main surface and a skirt portion extending from the main surface along the tube axis. The main surface has a central apertured portion with apertures each for allowing electron beams to pass through, and a nonapertured peripheral portion extending toward a peripheral portion of the main surface. The frame is disposed inside the skirt portion. The skirt portion of the shadow mask is fixed to an outer periphery surface of the frame by spot welding at a plurality of locations. The frame has a holder for fixing the shadow mask to the panel section at the given distance between the shadow mask and the phosphor screen. Low cost iron is used for the shadow mask and frame.

In the color picture tube of shadow mask type, three electron beams emitted from the electron guns are electromagnetically deflected,and thereafter, impinge to predetermined phosphors, e.g., R, G and B phosphors, through an aperture of the shadow mask serving as the color selecting electrode. However, when the color picture tube is operated, the shadow mask itself is thermally expanded by the incident electron beams. For this reason, the relative positional relationship between the center apertured portion of the shadow mask and the phosphor screen is changed. Thus, the location at which the electron beam impinges to the phosphor screen varies, and in an extreme case, the color purity of the phosphor screen is considerably degraded.

Generally, deformation of the shadow mask due to thermal expansion when the color picture tube is operated can be classified into two types.

In the first type, the temperature of the whole shadow mask is increased. Thus, the entire shadow mask and the frame are thermally expanded in a direction perpendicular to the tube axis. In the second type, if a particularly bright portion is locally present on the screen when the color picture tube is operated, a portion of the shadow mask corresponding to the bright portion is locally heated. In general, the portion of the shadow mask then thermally expands so as to extend along the tube axis in a so-called dome shape.

In the first type of deformation of the shadow mask, as disclosed in Japanese Patent Publication No. 44-3547, a bimetal member is interposed between the frame and the holder. The shadow mask assembly can be automatically compensated for by means of the bimetal member so as to approach to the phosphor screen formed on the inner surface of the panel portion in accordance with the increase in temperature of the entire shadow mask.

Meanwhile, as for the second type of deformation, since the thermal expansion occurs locally when the color picture tube is operated, no effective compensation method has yet been found as in the bimetal member mentioned in the first type of deformation, but various proposals have been made.

In one proposal, as disclosed in Japanese Patent Publication No. 42-25446, Japanese Patent Laid open Nos. 50-58977 and 50-68650, a material having a low thermal expansion coefficient, e.g., an invar alloy is used for the shadow mask assembly. However, such a metal having a low thermal expansion coefficient, e.g., invar alloy is expensive compared to iron. Therefore, the use of such a metal not only for the shadow mask but also for the frame results in a considerable increase in cost. Therefore, it is preferable that the metal having low thermal expansion coefficient be used only for the shadow mask which is relatively light in weight, and a low-priced iron material be used for the frame which is relatively heavy, because the volume of the frame is much larger than that of the shadow mask.

However, if different metals are used for the shadow mask and the frame, when the temperature of the overall shadow mask assembly becomes high, e.g., when the color picture tube is manufactured, the shadow mask is deformed due to the difference in thermal expansion coefficients. That is, as shown in FIG. 7, when the temperature of an overall shadow mask assembly 10 becomes high, a frame 12 made of an iron material having a high thermal expansion coefficient is greatly expanded, so that the outer periphery surface of the frame 12 pushes the skirt portion of a shadow mask 14 through a plurality of welding portions 15 between the shadow mask 14 and the frame 12, as indicated by arrows 16. On the other hand, since the shadow mask 14 is made of a material having a low thermal expansion coefficient, the shadow mask 14 itself is deformed very little. Thus, as indicated by imaginary lines 17, the shadow mask 14 is plastically deformed by tension from the entire outer periphery surface of the frame at its surrounding portion, i.e., at the periphery of its nonapertured and apertured portions along the tube axis in a direction away from the phosphor screen. Plastic deformation at the apertured portion degrades color purity on the phosphor screen.

In the above proposal, since the frame is formed smaller in size than a space defined by the inner side surfaces of the skirt portion of the shadow mask, a portion of the frame is disposed inside the skirt portion of the shadow mask. Finally in U.S. Pat. No. 4,056,755 (Sohn), the frame is formed larger than a space defined by the outer side surfaces of the skirt portion of the shadow mask, and a portion of the frame surrounds the skirt portion. However, in this case, the shadow mask and the frame are made of the same material, and no solution for plastic deformation of the shadow mask when different materials are used is disclosed.

SUMMARY OF THE INVENTION

It is an object of the present invention to provide a color picture tube comprising a shadow mask assembly which is free from the above described disadvantage of the conventional structures and uses different metals for the shadow mask and the frame so as to control local thermal expansion of the shadow mask when the color picture tube is operated and to prevent plastic deformation even in a high temperature state even if the color picture tube is manufactured.

The present invention is a color picture tube having a shadow mask structure comprising a shadow mask which has a main surface having a plurality of apertures and a skirt portion bent away from this main surface, and a frame supporting the skirt portion of the shadow mask, the frame being formed of a metal of a larger coefficient of thermal expansion than the shadow mask, and the shadow mask being welded to the frame at a plurality of points, in which this structure is disposed adjacent to phosphors provided on the inner surface of a surrounding envelope, and in which an electron beam emitted by an electron gun provided on the side opposite to the phosphors penetrates the apertures in the shadow mask and excites the phosphors, wherein the shadow mask is such that at least at the welding points of welding to the inner wall of the frame the skirt portion is subject to a compressive stress from the inner wall of the frame in the direction of the center of the shadow mask structure.

According to one aspect of the present invention, the skirt portion and frame portion are such that at the mutually opposing openings, the outer dimension Os of the shadow mask and the inner dimension $I_F$ of the frame satisfy the relation $$Os > I_f$$

and the skirt portion extending from the shadow mask is welded to the frame inner wall so that the skirt portion is subject to a compressive stress from the inner wall of the frame in the direction of center of the shadow mask structure.

Preferably the elastic deformation of the skirt portion is a maximum of 2 mm inward for each 10 mm extent of the skirt portion compared with the state before the skirt portion is attached to the frame, and at the welding points the elastic deformation is at maximum 2 mm.

DETAILED DESCRIPTION OF THE PREFERRED EMBODIMENTS

Figure 1:
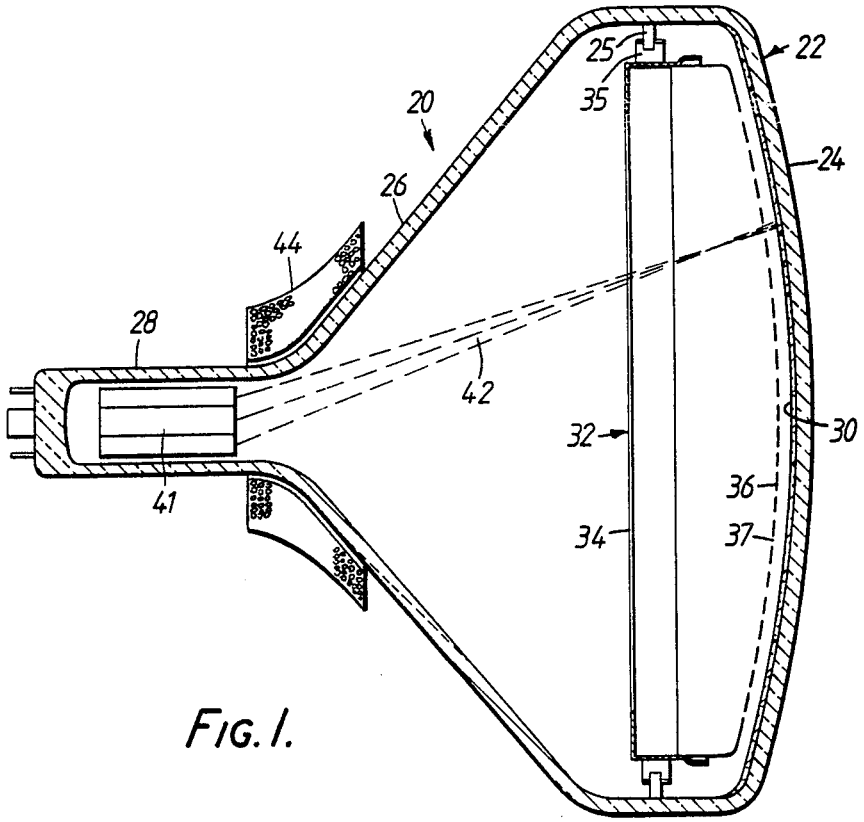
FIG. 1 is a longitudinal sectional view of one embodiment of the present invention.
Figure 7:
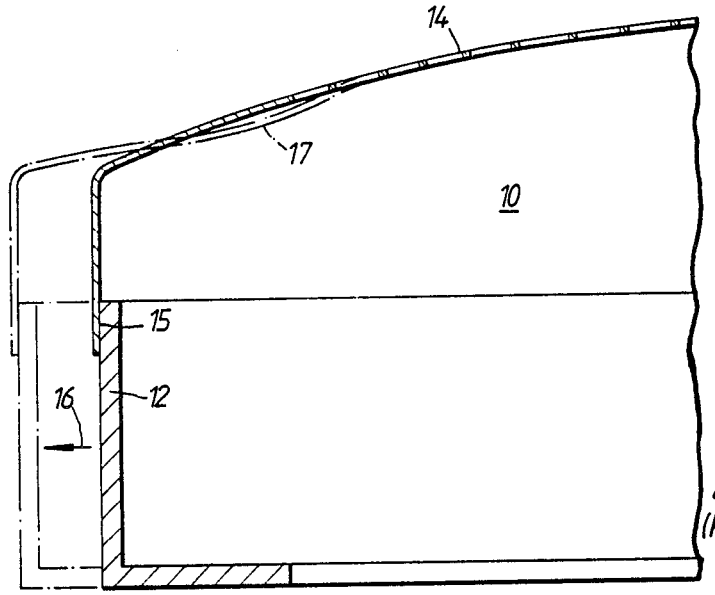
FIG. 7. (PRIOR ART)
FIG. 7 is a partial sectional view of a conventional structure.
Figure 2:
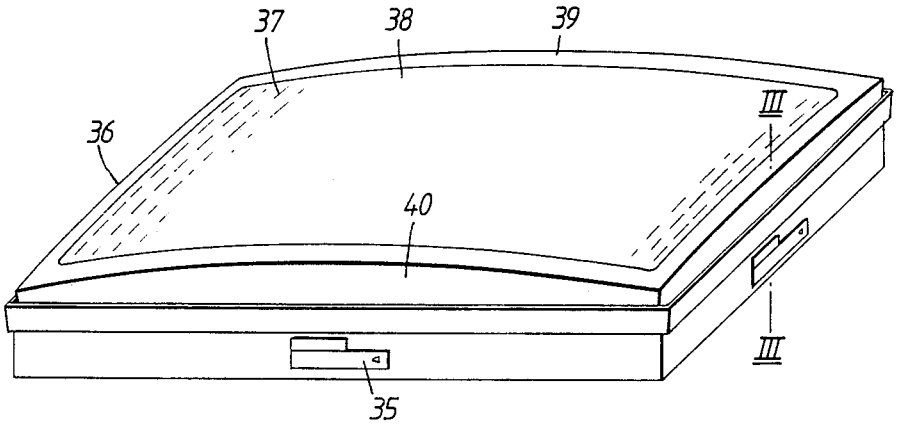
FIG. 2 is a perspective view of the shadow mask structure of the embodiment of FIG. 1.

FIGS. 1 to 5 show one embodiment of the present invention. A color picture tube 20 has a glass envelope 22 and this envelope 22 comprises a panel 24, a funnel 26 and a neck 28. The internal surface of the panel 24 is spherically concave, and on this surface is disposed a phosphor screen 30 in which phosphors of three colors are regularly arranged. The screen 30 has red, green and blue light emitting phosphors arranged in turn as stripe formations. The stripe orientation is in the shorter axis of the panel, or in other words vertically. A shadow mask structure 32 is mounted in proximity to screen 30. The shadow mask structure 32 comprises a rectangular frame 34 and a shadow mask 36 provided with a plurality of slit apertures 37, and is mounted elastically by stud pins 25 embedded in the skirt portion of panel 24 from spring support members 35 welded to the side of frame 34. The shadow mask 36 comprises an aperture portion 38 in which are formed a plurality of apertures 37, a peripheral portion 39 in which there are no apertures, and a skirt portion 40 extending from the peripheral portion 39 and bent away therefrom.

Within the neck portion 28 is fitted an in-line type electron gun 41, which produces three electron beams 42, which pass through apertures 37 and impinge on a phosphor screen 30. These electron beams 42 are deflected by a deflection yoke 44 fitted to the outer wall of the funnel 26, and scan the shadow mask 32 and the phosphor screen 30.

The shadow mask 36 is a 0.12 mm plate of an iron alloy including 36% nickel, namely invar, with a low coefficient of thermal expansion, whereas the frame 34 is of 1 mm iron.

Figure 3:
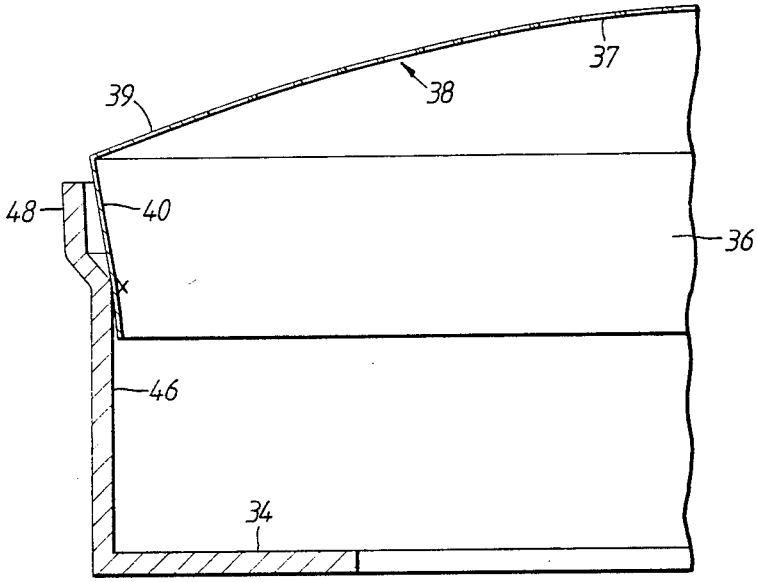
FIG. 3 is a sectional view taken along line III—III in FIG. 2.
Figure 4:
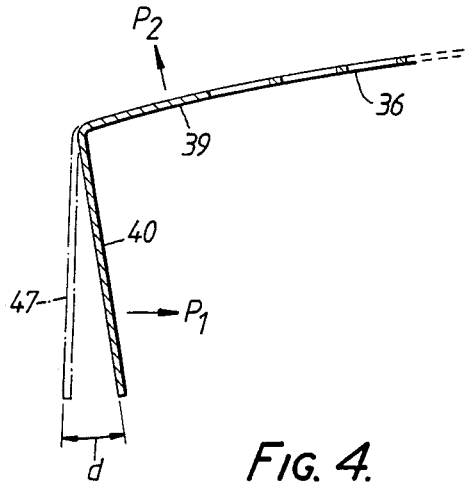
FIG. 4 is a schematic view explaining FIG. 1.

The shadow mask 36 is welded to the frame inner wall 46 at a number of points (shown by X in FIG. 3). There may be between two and four welding points on each side of the frame. When welding, skirt portion 40 is elastically deformed in the direction of the shadow mask structure 32 center (tube axis), and is fixed in that state. In other words, in FIG. 4 the dot-dash lines 47 shows the position of the skirt 40 before fitting the shadow mask 36 to frame 34, and the solid lines show the position after welding to the frame inner wall.

Skirt portion 40 therefore is subject to a compressive stress $P_1$ in an inward direction, and in the peripheral portion 39 and adjacent aperture portions 38 a stress $P_2$ is produced towards the phosphor screen.

The deformation towards the center of the mask structure is such that the compressive stress $P_1$ corresponds to an elastic deformation d of at maximum 2 mm for a skirt 40 length of 10 mm.

An enlarged flange 48 is formed on frame portion 34, so that skirt portion 40 may be easily inserted into frame 34.

Figure 5:
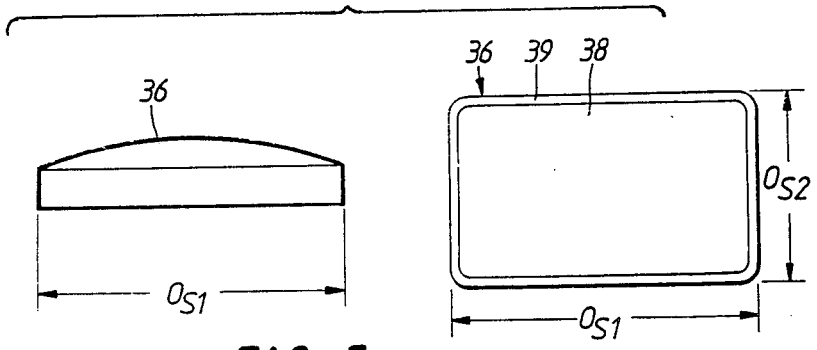
FIGS. 5(*a–c*) show different parts of the shadow mask structure for purposes of explanation of the present invention; 5(*a*) shows the shadow mask, 5(*b*) the frame portion, and 5(*c*) the shadow mask structure, in each of 5(*a*), 5(*b*) and 5(*c*) the left figure being a sectional view and the right figure a plan view.
Figure 5:
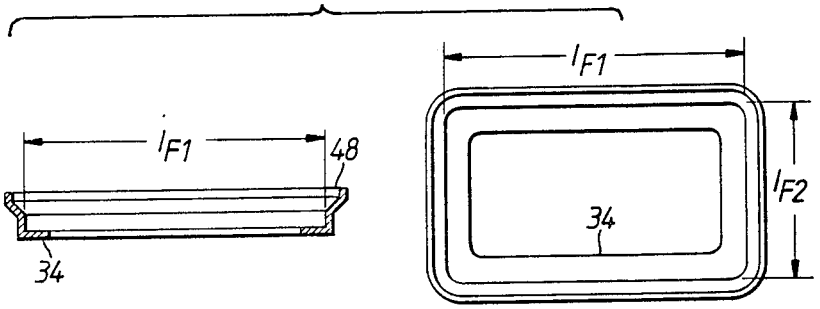
Figure 5:
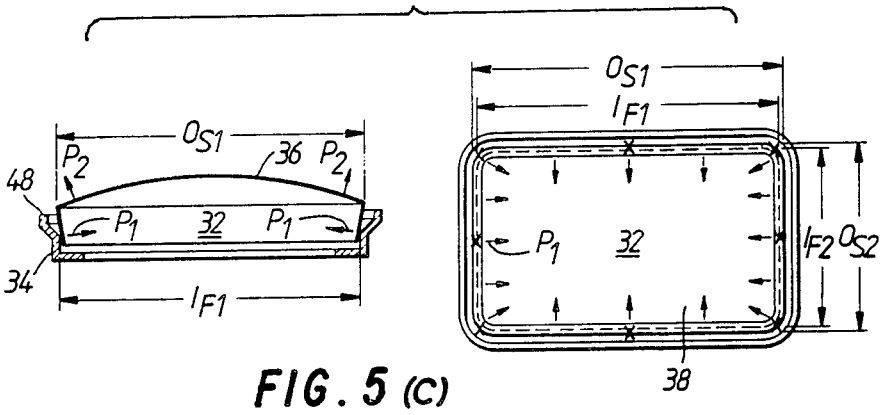

FIG. 5 shows the dimensions of shadow mask structure 32 and its components. In more detail, FIG. 5 (*a*) shows the shadow mask 36, FIG. 5 (*b*) the frame 34, and FIG. 5 (*c*) the shadow mask structure 32 when shadow mask 36 has been inserted within frame 34 and the two welded together. The outer dimension of the shadow mask in the longitudinal direction is indicated by $Os_1$ and the outer dimension in the cross-wise direction is indicated by $Os_2$. The inner dimensions of the frame 34 are indicated by $I_{F1}$ in the longitudinal direction and $I_{F2}$ in the cross-wise direction. In the present invention the terms outer dimension and inner dimension are used respectively to refer collectively to the longitudinal outer dimension of the side surfaces of shadow mask 36 and the cross-wise outer dimension thereof and to the longitudinal inner dimension of the side surfaces of frame 34 and the cross-wise inner dimension thereof. In FIG. 5 (*a*) and (*b*) the outer dimensions of the shadow mask are formed so as not to be less than the inner dimensions of frame 34. In other words they are constructed so that, in the above notation, the following relations hold;

$$Os_1 \geqq I_{F1}$$

$$Os_2 \geqq I_{F2}$$

There are, however, operational difficulties in inserting a larger sized shadow mask 36 into a smaller frame 34. To avoid these problems, and to achieve the lessened plastic deformation of the shadow mask structure which is an object of the present invention, it is necessary for the construction to be such that, at least at the welding points, the $Os_1$, $Os_2$, $I_{F1}$ and $I_{F2}$ satisfy the relations;

$$O \leqq Os_1 - I_{F1} \leqq 2 \text{ mm}$$

$$O \leqq Os_2 - I_{F2} \leqq 2 \text{ mm}$$

It should be noted that in FIG. 5 (*c*) the welding points are indicated by X.

The undesirable distortion of the shadow mask is caused by heating of the shadow mask structure. During the manufacturing processes of a color picture tube, the shadow mask structure is heated to at least 400° C. in the stabilization stage, evacuation stage and so forth. Also during operation of the color picture tube, with for example a 21 inch tube, an anode potential of 25 kV, and anode current of 1200 μA, the aperture portion 38 is heated to approximately 70° C. by the impinging electron beam. The shadow mask, which has a low coefficient of thermal expansion, is therefore pulled by the frame, which has a higher coefficient of thermal expansion, but in the present embodiment, because of the compressive stress, the tension force is reduced, compared with a construction without this compressive stress, and the plastic deformation produced can be remarkably reduced.

Figure 6:
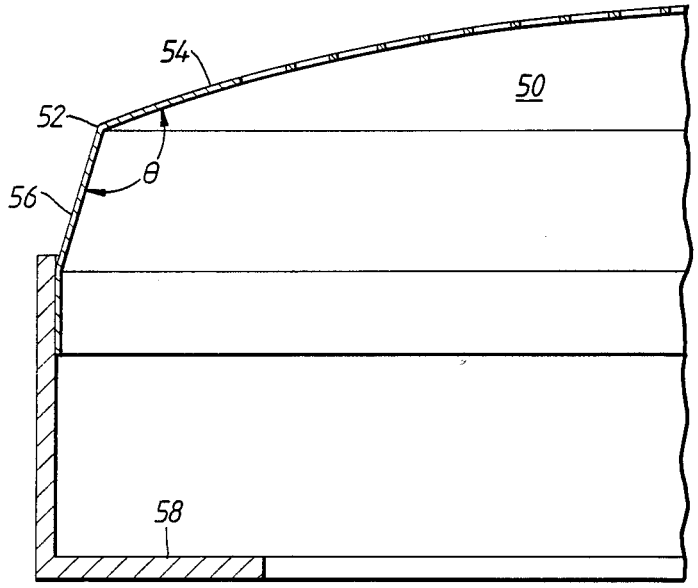
FIG. 6 is a partial sectional view of another embodiment of the present invention.

FIG. 6 illustrates another embodiment, in which the angle of bending of the bending portion 52 of the shadow mask 50 between the border portion 54 and skirt 56 is obtuse, and the compressive stress $P_1$ is applied to the skirt portion 56. With this construction, the operation of inserting the shadow mask 50 into the frame 58 is even easier than in the previous embodiment.

According to the present invention described above, with a shadow mask using a metal of a lower coefficient of thermal expansion than that of the frame portion, a color picture tube can be obtained in which the color purity degradation due to both overall and localised thermal deformation during operation of the shadow mask and deformation during manufacture can be reduced or removed.

What is claimed is:

1. In a color picture tube comprising:

a shadow mask structure comprising a shadow mask which has a main surface having a plurality of apertures and a skirt portion bent away from said main surface; and a frame supporting said skirt portion of said shadow mask, said frame being formed of a metal of a larger coefficient of thermal expansion than said shadow mask, and said shadow mask being welded to an inner wall of said frame at a plurality of points, in which this structure is disposed adjacent to phosphors provided on the inner surface of a surrounding envelope, and in which an electron beam emitted by an electron gun provided on the side opposite to the phosphors penetrates the apertures in the shadow mask and excites said phosphors;

wherein at least at the welding points of welding to the inner wall of said frame, said skirt portion of said shadow mask is subject to a compressive stress from the inner wall of said frame in the direction of the center of the shadow mask structure, said compressive stress reducing tension force produced in said shadow-mask upon thermal expansion of said frame thereby to reduce plastic deformation in said shadow mask.

2. A color picture tube as claimed in claim 1, wherein said shadow mask structure is rectangular, that said skirt portion extending from the edge of said main surface of said shadow mask is such as to produce an elastic deformation of 2 mm at maximum.

3. A color picture tube as claimed in claim 1, wherein the angle made by said skirt portion with said main surface of said shadow mask at the bent portion is obtuse.

4. A color picture tube as claimed in claim 1, wherein said skirt portion and frame portion are such that at the mutually opposing openings, the outer dimension Os of said shadow mask and the inner dimension $I_F$ of said frame satisfy the relation $$Os > I_F$$

and said skirt portion extending from said shadow mask is welded to the frame inner wall so that said skirt portion is subject to a compressive stress from the inner wall of said frame in the direction of center of said shadow mask structure.

5. A color picture tube as claimed in claim 1, wherein the elastic deformation of said skirt portion is a maximum of 2 mm inward for each 10 mm extent of said skirt portion compared with the state before said skirt portion is attached to said frame.

6. A color picture tube as claimed in claim 1, wherein said shadow mask is of Fe-Ni alloy and said frame substantially of iron.

7. A color picture tube as claimed in claim 1, wherein said frame has an enlarged flange having a larger inner dimension than the outer dimension of said skirt portion.

* * * * *

UNITED STATES PATENT AND TRADEMARK OFFICE

CERTIFICATE OF CORRECTION

PATENT NO. : 4,739,216

DATED : Apr. 19, 1988

INVENTOR(S) : Hidetoshi YAMAZAKI, et al.

It is certified that error appears in the above-identified patent and that said Letters Patent is hereby corrected as shown below:

The Title page should be corrected to indicate four (4), rather than five (5), sheets of drawings.

Signed and Sealed this

Sixteenth Day of August, 1988

*Attest:*

*Attesting Officer*

DONALD J. QUIGG

*Commissioner of Patents and Trademarks*